United States Patent [19]

Westenberger

[11] Patent Number: 5,014,666

[45] Date of Patent: May 14, 1991

[54] LOAD ADJUSTMENT DEVICE

[75] Inventor: Helmut Westenberger, Hofheim, Fed. Rep. of Germany

[73] Assignee: VDO Adolf Schindling AG, Frankfurt/Main, Fed. Rep. of Germany

[21] Appl. No.: 556,884

[22] Filed: Jul. 20, 1990

[30] Foreign Application Priority Data

Aug. 16, 1989 [DE] Fed. Rep. of Germany ..... 3927004

[51] Int. Cl.[5] ..... F02D 33/00; F02D 9/02; F02D 1/02

[52] U.S. Cl. ..... 123/339; 123/399; 123/400

[58] Field of Search ..... 123/339, 340, 342, 361, 123/399, 400, 403

[56] References Cited

U.S. PATENT DOCUMENTS

| | | | |
|---|---|---|---|
| 4,354,466 | 10/1982 | Dudley et al. | 123/339 |
| 4,590,906 | 5/1986 | Uriuhara et al. | 123/339 |
| 4,736,722 | 4/1988 | Ciampolini et al. | 123/339 |
| 4,848,297 | 7/1989 | Hickmann et al. | 123/361 X |
| 4,873,957 | 10/1989 | Ueyama et al. | 123/400 X |
| 4,896,640 | 1/1990 | Pfalzgraf et al. | 123/399 |
| 4,903,936 | 2/1990 | Kajiwara | 123/399 X |
| 4,919,097 | 4/1990 | Mitui et al. | 123/400 X |
| 4,953,529 | 9/1990 | Pfalzgraf et al. | 123/399 X |
| 4,960,091 | 10/1990 | Aufmkolk | 123/399 |

FOREIGN PATENT DOCUMENTS 59-5865 1/1984 Japan .

*Primary Examiner*—Willis R. Wolfe
*Attorney, Agent, or Firm*—Martin A. Farber

[57] ABSTRACT

A load adjustment device with which the power of an internal combustion engine can be controlled has a driver (4) which is coupled with an accelerator pedal (1). The driver cooperates via a control element with a setting member (throttle 9) which determines the power of the internal combustion engine. The control element has a first control-element part (8*a*) and second control-element part (8*b*) which can be decoupled from each other in order to be able to control the setting member (9) independently of the driver (4) via an electric setting drive (14). Within the second control-element part (8*b*) there is present, in accordance with the invention, a step-up transmission (torque converter 30*a*) for movement on the setting drive side, the torque converter being developed as a spiral. An emergency operation spring (20) urges the second control-element part (8*b*) in direction of maximum idle position into an idle emergency position, and transfers the setting member (9) into an emergency operating position, upon a failure of the electric setting drive or of a device (17) electronically controlling the load adjustment device. An auxiliary spring (31) is pretensioned in the direction of minimum idle position to overcome a deactivated electric setting drive.

12 Claims, 3 Drawing Sheets

LOAD ADJUSTMENT DEVICE

FIELD AND BACKGROUND OF THE INVENTION

The present invention relates to a load adjustment device having a control element which acts on a setting member which determines the output of an internal combustion engine, the control element cooperating with a driver which is coupled to an accelerator pedal and, in addition, being controllable by an electric setting drive which cooperates with an electronic control device.

Load adjustment devices, for instance load adjustment devices which cooperate with carburetors or injection pumps, must satisfy the requirement of optimal regulation of the internal combustion engine over the entire range of loads. For this purpose, a complicated construction or control of the corresponding load adjustment device is required. Thus carburetors, for instance, in addition to the actual means for the formation of the mixture, have additional devices such as leaning, starting, idling, accelerating and economizing devices, etc. These means complicate the construction of the carburetor and result in a high expense for structural parts, in particular, for instance, additional injection nozzles, pumps, special developments of the nozzle needles, separate air feeds are necessary, entirely aside from the high control requirements connected therewith.

It is particularly important in load adjustment devices to control the state of load upon idling, at which only minimum power is given off by the internal combustion engines. But, as compared with certain circumstances, particularly in motor vehicles, there may be load-consuming devices which require extensive power, such as fans, rear-window heating, air conditioning, etc. In order to take these possible power requirements into account, control of the load adjustment device between a maximum idle position and a minimum idle position is necessary. Upon failure of the control, an emergency idle position of the setting member or control member is to be assured.

In contradistinction to the problem described above, load adjustment devices of the type indicated are used, as a general rule, in cases where the accelerator pedal and the setting member are electronically connected to each other. The accelerator pedal is coupled with the driver and the latter is coupled with the control element. Furthermore, a desired-value detection element which is associated with the driver and an actual-value detection element which cooperates with the desired-value detection element and acts on the electric setting drive are provided. The electric setting drive is adapted to be controlled by the electronic control means as a function of the values detected. The electrical connection of accelerator pedal and setting member with the electronic control means interposed between them makes it possible to set desired-value positions predetermined by the accelerator pedal and the driver connected with it with reference to the actual values indicated by the position of the control element and of the setting member. The values are checked for the existence or absence of plausibility conditions, so that if certain plausibility conditions are present or absent, the possibility exists of acting, via the electronic means by control of the electric setting drive, on the setting member, which may be developed, for instance, as throttle valve or injection pump, in order to correct it. Thus, for instance, action by the electronic control means may be provided in order to avoid wheel slippage upon starting as a result of the giving of excessive power through the gas pedal. Other automatic interventions in the load adjustment device are, for instance, conceivable in connection with automatic shifting processes of a transmission, a speed-limiting control, or the above-mentioned idling control of the internal combustion engine.

SUMMARY OF THE INVENTION

It is an object of the present invention to create a load adjustment device of the aforementioned type which, while of structurally simple development, permits reliable and exact control of the internal combustion engine over the entire idling range.

According to the invention, the adjustment path of the driver (4) in idling direction is limited by an idle stop (LL). When the driver (4) comes against the idle stop (LL), the control element (8*a*, 8*b*) is moveable within its idling control range relative to the driver (4) by means of the setting drive (14). The control element (8*a*, 8*b*) has a first control element part (8*a*) which cooperates with the driver (4). An idle spring (12*a*) on the driver (4) urges the control element part (8*a*) in the direction of minimum idle position over the entire idle control range. The control element (8*a*, 8*b*) has a second control element part (8*b*) which is controlled by means of a setting drive (14). An emergency operation spring (20) on the setting drive (14) urges the control element part (8*b*) in the direction of the minimum idling position and into an idling emergency position. The first control element part (8*a*) extends on the side associated with the maximum idle position of the second control element part (8*b*) into the setting path thereof, and the second control element part (8*b*) comprises a torque converter (30*a*) developed as a spiral (82*b*).

Based on the development of the load adjustment device in accordance with the invention, control is accomplished within the entire idling control range exclusively by means of a single setting member so that no additional means are required for forming the mixture within the idle control range. The control element which moves the setting member is moveable independently of the driver within the idle control range by means of the electric setting drive, while outside the idle control range it is coupled to the driver, and the latter can move the control element and thus the setting member. In this connection, there is of particular importance the development of the control element with the two control-element parts, the first control element, which cooperates directly with the setting member, representing, on the one hand, the connection to the driver and, on the other hand, via the second control-element part, the connection to the electric setting drive. In this case, the idle spring serves for restoring the first control-element part. In an increased idling position of the second control element due to the superimposing of the setting path of the two control-element parts, the idle spring serves also for the restoring the second control-element part, while the emergency operation spring cooperates exclusively in the opposite direction of action with the second control-element part.

By the subdivision of the control element into the first and second control-element parts, assurance is had that the movement of the driver can take place independently of the elements associated with the electric setting drive upon partial-load/full-load operation of the internal combustion engine, and this exclusively against the direction of action of the one spring in the form of the idle spring. In accordance with a special feature of the solution of the invention it is finally provided that the second control-element part comprises a torque converter which is developed as a spiral.

In particular, when the setting member is developed as throttle valve it is merely necessary, in order to regulate the idle of the internal combustion engine, to swing the throttle valve within a small region of swing which, in general, is less than 10°. Such small swinging regions, however, cannot be obtained at all or only at high regulation expense by means of electric setting drives, particularly if they are to be developed as electric motors of comparatively small type. By the invention in the nature of the spiral effecting the stepping-up, it becomes possible to use electric setting drives of low output torque, the output movement of which, extending over a relatively large range of swing or rotation, is converted into a movement of the throttle valve in said small region of swing.

In accordance with a preferred embodiment of the invention it is provided that the region of the second control-element part (8*b*) which extends into the setting path of the first control-element part (8*a*) is developed as a lever (86*b*) which is swingable around a stationary shaft (84*b*), the end of which lever which is remote from the mounting shaft and has a guide extension (87*b*) which is arranged parallel to the mounting shaft (84*b*), the drive shaft (80*b*) of the setting drive (electric motor 14) being arranged parallel to the mounting shaft (84*b*) and having, fixed for rotation with it, a cam disk (81*b*) with a spiral cutout (82*b*) in which the guide extension (87*b*) is guided.

Furthermore, it is considered advantageous for the guide extension (87*b*) to pass through the cutout (82*b*) and for a stop (88*b*) which extends into the path of movement of the guide extension (87*b*) to be mounted freely swingable on the drive shaft (80*b*) for the disk, an emergency operation spring (20) being developed as a spiral spring one end of which is connected to the stop (88*b*) and the other end to a stationary point or to the cam disk (81*b*). The guide extension thus serves not only for the transmission of the movement of the setting drive via the cam disk to the first control-element part but also, in cooperation with the emergency operation spring, for a well-defined transfer of the setting member into the emergency operation position in the event of failure of the electric setting member or of the electronic control means. In order to optimize the friction conditions between the guide projection and the spiral cutout, the extension can be provided also in the region of its passage through the cutout with an anti-friction bearing which is furthermore guided there with slight clearance.

The emergency operation spring (20) should advantageously be urged towards an emergency-position stop (22) in order, in this way, to provide assurance that, upon failure of the electric setting drive or of the electronic control means, the setting member will assume a well-defined position.

An emergency position stop (22) can be connected to the cam disk (81*b*) and extend into the path of movement of the stop (88*b*) which is associated with the guide extension (87*b*). With such an arrangement, regulation over a larger total angle is possible; aside from this, the emergency operation spring, however, could also rest against a stationary point.

In accordance with one particular embodiment of the invention, it is furthermore provided that an auxiliary spring (31) cooperate with the drive shaft (80*b*) of the setting drive (14) and urge the latter in idling direction of the setting member (throttle valve 9) over the entire idle control range. The auxiliary spring serves to reset the throttle valve and it thereby is of particular importance since, due to the step-up of the movement of the electric setting motor, the drive shaft of the latter can be displaced through large regions of swing. Assurance can be had that upon failure of the electronic control means or of the electric setting drive, the second control-element part is brought, in opposition to the friction/detent moment of the setting drive, into the idling position. In this connection, the spring force of the emergency operation spring should be so dimensioned that it can overcome not only the force of the idling spring but, in addition, also the force of the auxiliary spring and other forces acting in the system; these other forces can be caused, for instance, in case of the development of a setting member as a throttle valve mounted eccentrically for reasons of safety, by the vacuum forces in the intake pipe which act in closing direction on said valve. In this case, it is advantageous for the auxiliary spring to be associated with the second control-element part, and for the two control-element parts to be uncoupled from one another in the partial-load/-full-load region, in which case, in these operating conditions the first control-element part need not be additionally moved by the driver against the force of the auxiliary spring. Structurally, the auxiliary spring is advantageously developed as a spiral spring which surrounds the drive shaft and one end of which acting on a stop arranged on the drive shaft, the other end acts on a stationary point.

According to a feature of the invention, the spiral (82*b*) is developed as non-self-locking spiral.

One particular embodiment of the invention contemplates that the spiral (82*b*) be developed as an Archimedes screw. It should furthermore have such a pitch that it is nonlocking. By means of this spiral, step-up ratios (i) from setting drive to setting member of advantageously 50 to 200 should be obtainable, particularly 70 to 100.

As a result of the stepping-up of the movement of the electric setting drive, it is finally considered advantageous for a structural part which establishes the position of the second control-element part, and particularly the actual-value detection element, to be associated with the lever which is swingable around the stationary shaft, and thus at a place where the position of the setting member can be more precisely detected as a result of the stepping-up.

According to another feature of the invention, the auxiliary spring (31) is developed as a spiral spring which surrounds the drive shaft (80*b*) and which, at one end, acts on an extension (89*b*) arranged on the drive shaft (80*b*) and, on the other end, acts on a stationary point (32).

Still further according to the invention, a structural part (18) which establishes the position of the second control-element part (8*b*) is associated with a lever (86*b*) which is swingable around the stationary shaft (84*b*).

BRIEF DESCRIPTION OF THE DRAWINGS

With the above and other objects and advantages in view, the present invention will become more clearly understood in connection with a detailed description of a preferred embodiment when considered with the accompanying drawings, of which.

DETAILED DESCRIPTION OF THE PREFERRED EMBODIMENT

Figure 1:
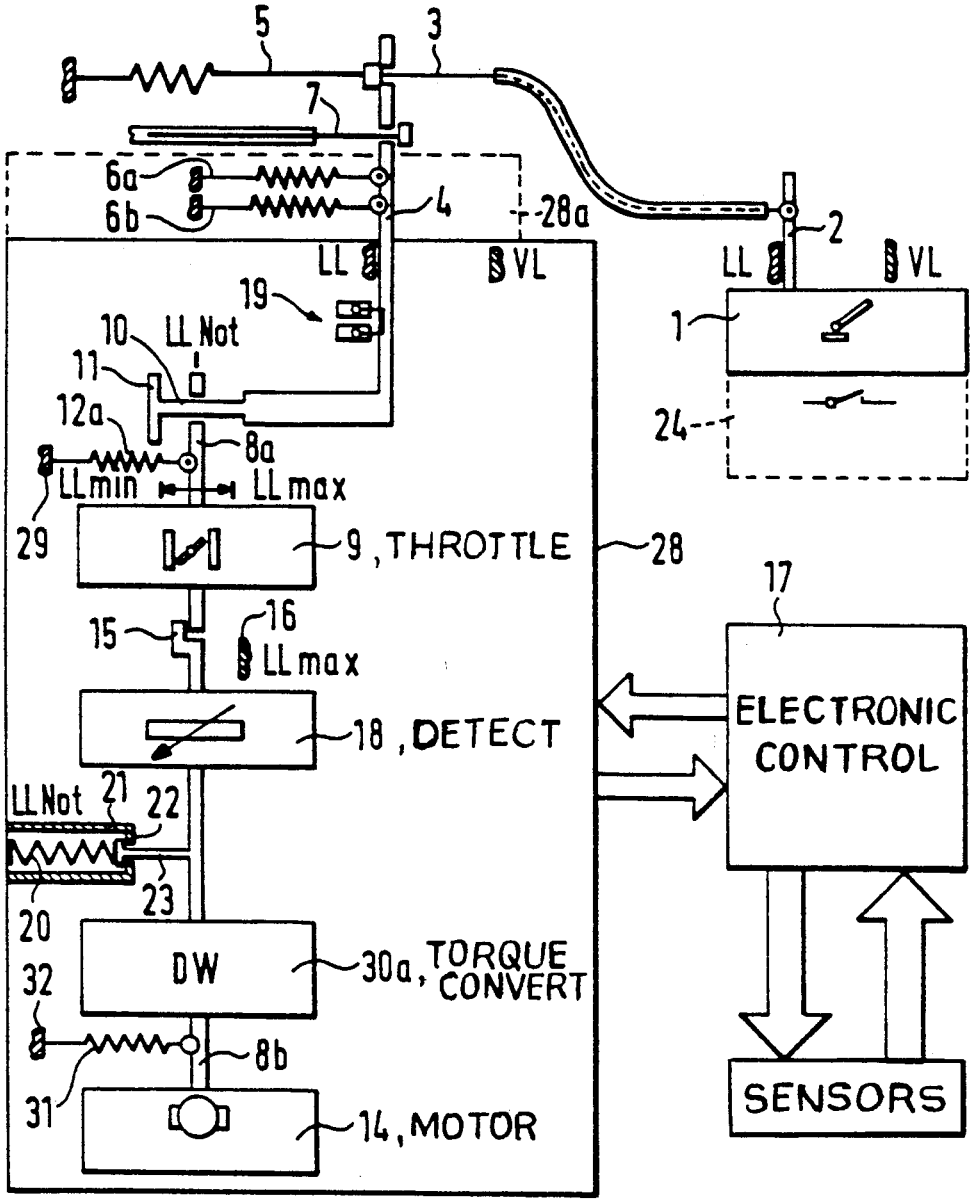
FIG. 1 is a block diagram of the load adjustment device of the invention in the idle control function, shown in the emergency operation position.

FIG. 1 shows an accelerator pedal 1 by which a lever 2 can be displaced between an idle stop LL and a full-load stop VL. The lever 2 is able, via a gas cable 3, to displace a driver 4, moveable between another idle stop LL and another full-load stop VL, in the direction of the full-load stop VL associated with it. The driver 4 is urged in idle direction by a return spring 5 which is attached to the gas cable 3. Two return springs 6*a* and 6*b* which act on the driver 4 urge the latter in idle direction, the two springs 6*a* and 6*b* being so designed that they have redundant effects on the reset drive each individual one of them being able to apply the forces in order to transfer the driver 4, even if opposing system forces acting on the driver 4 are taken into consideration, into its idle position. When the gas cable 3 is not acted on, the driver 4 thus lies against the idle stop LL associated with it. The driver 4 can also displace an automatic cable 7 of an automatic transmission, not shown in detail.

Figure 3:
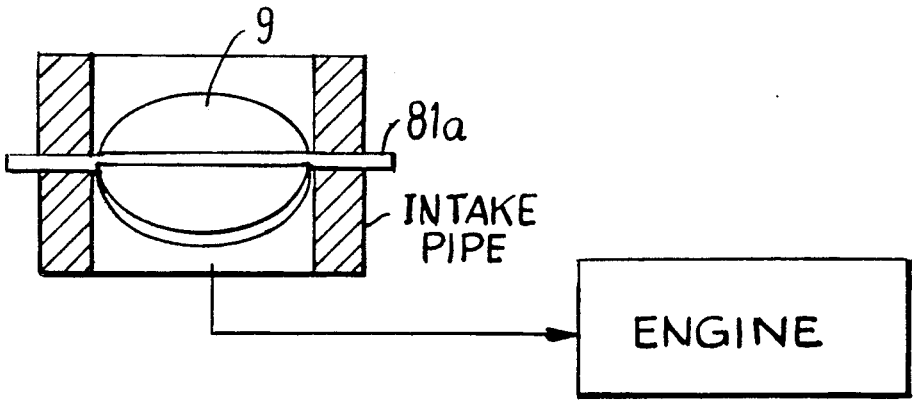
FIG. 3 shows an intake pipe (in longitudinal sectional view) connected to an engine (indicated diagrammatically), there being a throttle valve in the intake pipe.

The driver 4 cooperates directly with a first control-element part 8*a* which serves for the displacement of a setting member of the internal combustion engine, the setting member being is developed as throttle valve 9 within the intake pipe of an engine (FIG. 3). In detail, the end of the first control-element part 8*a* facing the driver 4 is provided with a recess 10 which engages behind an extension 11 of the driver 4. Between the control-element part 8*a* and a fixed point 29 there is arranged an idle spring 12*a* which acts on the control-element part 8*a* to move it in idle direction over the entire idle control range ($LL_{min}$ to $LL_{max}$). At a minimum idle position of the first control-element part 8*a*, the latter rests against the extension 11 of the driver 4. Furthermore, upon a movement of the driver 4 via the accelerator pedal 1 outside of the idle control range, i.e. in partial-load/full-load operation, the first control-element part 8*a* acts on the setting member 9 and is displaced corresponding to the movement of the driver 4.

The load adjustment device of the invention is provided not only with the first control-element part 8*a* but also with a second control-element part 8*b* which is connected to an electric setting motor 14. Within the second control-element part 8*b*, a stepping-up of the movement on the setting-motor side takes place by means of a torque converter 30*a* the construction of which will be described in further detail below. Between the torque converter 30*a* and the electric motor 14, one end of an auxiliary spring 31 acts on the second control-element part 8*b*, and the other end of the spring is connected to another fixed point 32. The auxiliary spring 31 urges the second control-element part 8*b* in the direction of minimum idle position over the entire idling control range.

In order to be able to connect the two control-element parts 8*a* and 8*b* mechanically to each other, the second control-element part 8*b* has an extension 15, the first control-element 8*a* extending on the side of the extension 15 facing the maximum idle position into the setting path of said extension and thus into the setting path of the second control-element part 8*b*. A movement of the second control-element part 8*b* in $LL_{max}$—or full-load direction or $LL_{min}$ direction thus leads to the application of the extension 15 against the first control-element part 8*a*. Then, by means of the electric motor 14, the second control-element part 9*b* can be displaced against the force of the spring 12*a* in the direction of the maximum idle position or against the force of an emergency-operation spring 20 via a ram 23 against a stop 22 into the $LL_{min}$ position. As can be noted from FIG. 1, the displacement path of the second control-element part 8*b*, and thus also the displacement path of the first control-element part 8*a* in direction of the maximal idle position, is limited by a stop 16 which extends into the path of the second control-element part 8*b* at the position of the maximum idle $LL_{max}$. A limiting of the second control-element part 8*b* in the position of the minimum idle position is not necessary since either the first control-element part 8*a* rests in this position against the extension 11 of the driver 4, or the second control-element part 8*b* comes against a stationary sleeve 21.

The control of the load adjusting device of the invention is effected by means of an electronic control means 17. With it there cooperates an actual-value detection means 18 for the idle range which is associated with the second control-element part 8*b*, determines the instantaneous position of the first control-element part 8*a*, and is arranged adjacent the extension 15. By the electronic control means 17 there are furthermore detected signals which come from an idle contact 19 which is always activated when the driver 4 lies against the idle stop LL associated with it. Furthermore, external variables of state concerning the internal combustion engine or, in general, concerning the motor vehicle equipped with it, as may be provided by various engine sensors of temperature, pressure for example, are present in the control electronics 17 and called up by it and transferred from the control electronics to the electric motor 14 acting on the second control-element part 8*b*. The electronic control means 17 thus serves, in cooperation with the actual-value detection means 18 and the idle contact 19 as well as the external reference variables, for the purpose of building up a safety logic concerning the control of first and second control-element parts 8*a* and 8*b* as well as driver 4.

If the lever 2 cooperating with the accelerator pedal 1 is in its idle position LL, and the driver 4 is thus also against the idle stop LL, contacting of the idle contact 19 takes place. Upon the presence of plausibility conditions, the electric motor 14 is activated via the electronic control means 17, whereby the setting member 9, as desired by the control electronics 17, is controlled in the idling range between the minimum idle position and a maximum idle position. Plausibility conditions are, in this case, verified inter alia by means of the actual-value detection means 18, with which the entire idle control range of the internal combusion engine can be represented.

Should the electronic control means 17 or the electric motor 14 be without voltage, the path-limited emergency operation spring 20 which is pretensioned in the direction of maximum idle position effects the transfer of the second control-element part 8*b* into the idle emergency position $LL_{Not}$. In order to be able to effect this, the force of the emergency operation spring 20 must be so great that it overcomes not only the force of the idle spring 12*a* but, in addition, also that of the auxiliary spring 31 as well as the vacuum forces in the intake (suction) pipe which act on the throttle valve 9 in closing direction since customarily the throttle valve is mounted eccentrically so that a vacuum always urges the throttle valve into the closing direction. Upon a movement of the second control-element part 8*b* by means of the electric motor 14 in the direction of the minimum idle position, a cocking of the emergency operation spring 20, on the other hand, takes place.

In the event that, after the release of the accelerator pedal 1, the driver 4 cannot be displaced in the idle direction, a contact switch 24 is provided on the accelerator pedal 1 by which such an error condition can be noted.

By the frame 28 in FIG. 1 it is indicated that the parts surrounded by it form a structural unit. The additional dash-line frame 28*a* is intended to show that also the reset drive of the driver 4 represented by the springs 6*a* and 6*b* may be part of the structural unit.

Figure 2:
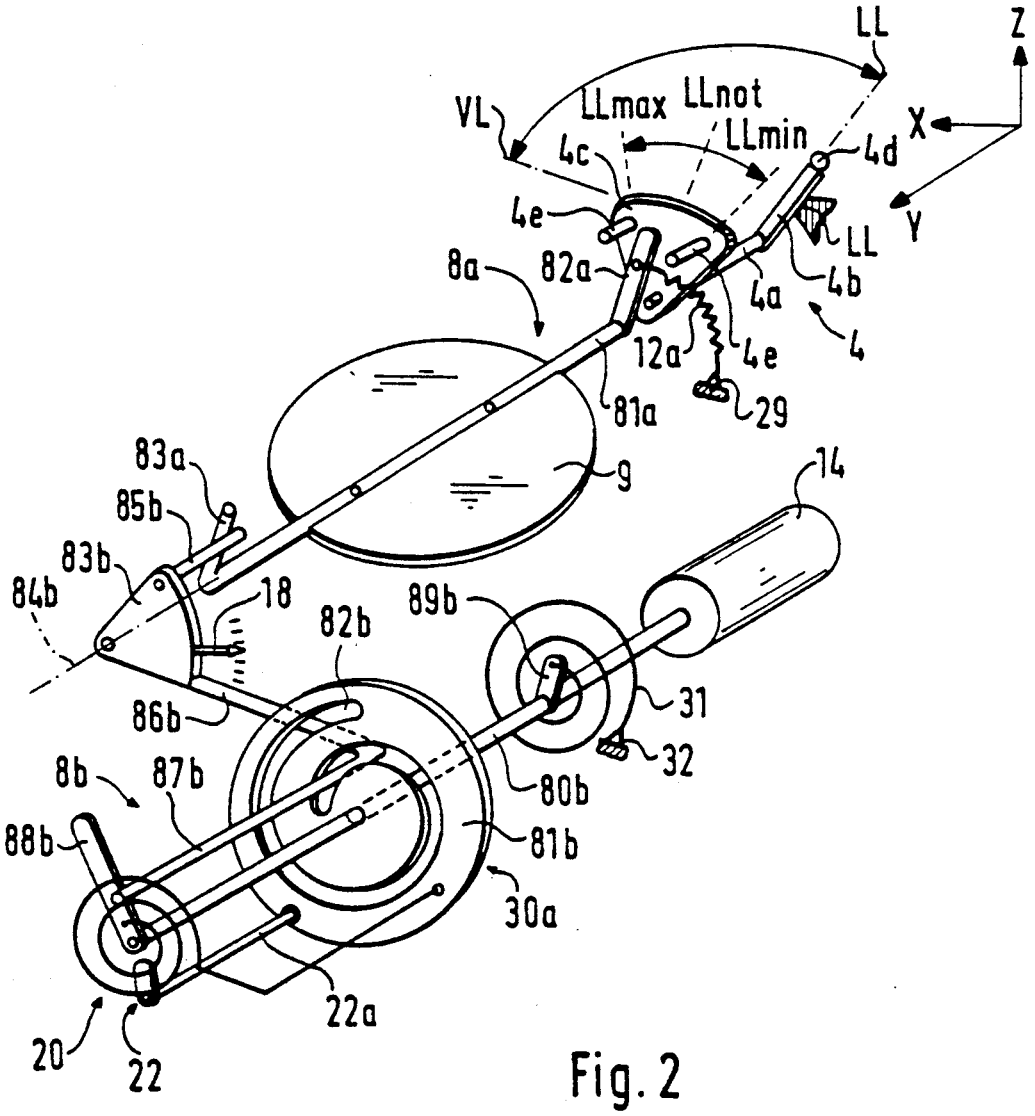
FIG. 2 shows a basic construction of such load adjustment device having a setting member in the form of a throttle valve.

FIG. 2 shows the interaction of driver 4 and the two control-element parts 8*a* and 8*b*, and furthermore the construction, in principle, of the torque converter 30*a* as well as the arrangement of the springs 12*a*, 20 and 31 acting on the two control-element parts 8*a* and 8*b*. The Figure shows first of all the driver 4, which consists essentially of a mounting shaft 4*a* swingable around the Y-coordinate, a lever 4*b* rigidly connected to said shaft, and a plate 4*c* spaced from said lever and also rigidly connected to the mounting shaft 4*a*. In the position shown in FIG. 2, the lever 4*b* of the driver 4 rests against the idle stop LL. The end of the lever 4*b* facing away from the mounting shaft 4*a* is provided with a ball pin 4*d* for connection to the gas cable 3, not shown in detail. The plate 4*c* has, essentially, the shape of a triangle. In the corners of the plate 4*c* which are distant from the mounting shaft 4*a*, two bolts 4*e* extending in Y direction are connected to said plate, they, in accordance with the arrangement of the extension 11 and the adjacent thickening of the driver 4 as shown in FIG. 1, forming a free travel for the first control-element part 8*a*. The latter has a mounting shaft 81*a* extending in the direction of the Y-coordinate and which receives, fixed for rotation, the setting member 9 developed as a throttle valve. The end of the mounting shaft 81*a* which faces the driver 4 is connected, fixed for rotation, with a lever 82*a* which extends into the space between the two bolts 4*e* and is thus limited in its relative swinging motion with respect to the driver 4. The lever 82*a* tensions the idle spring 12*a* in idle direction of the setting member 9, said spring being fastened to a stationary point. Finally, the end of the mounting shaft 81*a* facing away from the lever 82 is connected to a lever 83*a*.

On the electric motor side, the load adjustment device has, first of all, the drive shaft 80*b* which is connected to the electric motor 14 and receives, fixed for rotation, a cam disk 81*b*. The latter is provided with a spiral cutout 82*b* which, referred to the direction of view of FIG. 2, is directed clockwise outwards. The spiral is developed as an Archimedes screw and should extend over an angular region of 540° to 720° and thus over one-and-a-half to two revolutions of the electric motor 14; solely for reasons of clarity in the drawing, an angular region of less slightly more than one revolution has been shown.

A triangular plate 83*b* is swingably mounted around a mounting shaft 84*b* present in alignment with the mounting shaft 81*a* of the first control-element part 8*a* and it has, in a corner facing away from the mounting shaft 84*b*, a bolt 85*b* which extends parallel to the mounting shaft 84*b* and extends into the setting path of the lever 83*a*, and these two parts thus cooperate in the sense of the stop 15 in accordance with the showing of FIG. 1. The other corner of the plate 83*b* facing away from the mounting shaft 84*b*, has a lever 86*b* directed away from the mounting shaft 84*b* and guided parallel to the cam disk 81*b* on the side thereof facing the electric motor 14 and the free end of which has a guide extension 87*b* directed parallel to the mounting shaft 84*b* and the drive shaft 80*b*. Said guide extension passes through the spiral recess 82*b* with slight play.

Corresponding to the length of the guide extension 87*b*, the drive shaft 80*b* is also extended beyond the cam disk 81*b* and at its free end rotatably receives a radially-extending lever 88*b*, the free end of the guide extension 87*b* being located in the path of movement of the lever 88*b*. Within the path of movement of the lever 88*b*, there is finally arranged a stop 22 for the idle emergency position in the manner that a support bar 22*a* is connected, parallel to the drive shaft 80*b*, to the cam disk 81*b*. The bar 22*a* receives rigidly attached on its end facing away from the cam disk 81*b*, the stop 22 which cooperates in the idle emergency position with the lever 88*b*. The emergency operation spring 20 is developed as a spiral spring and its inner end cooperates with the lever 88*b* while it is fastened at its bent end to the cam disk 81*b*, whereby it urges the lever 88*b* against the guide extension 87*b* until the idle emergency position is reached and thus lies against the stop 22.

The drive shaft 80*b* is encircled by the auxiliary spring 31, which is also developed as a spiral spring and the inner end of which acts on a lever 89*b*. The lever 89*b* is connected, fixed for rotation, about the drive shaft 80*b* and with its outer end fastened at stationary point 32. While the emergency operation spring 20 urges the drive shaft 80*b* and thus the second control-element part 8*b* as a whole in the direction of maximum idle position and into the idle emergency position, the auxiliary spring 31 urges the drive shaft 80*b* and thus the second control-element part 80*b* as a whole in the direction of minimum idle position over the entire idle control range.

Upon operation by electric motor of the setting member 9, the rotary movement of the drive shaft 80*b* is stepped up by means of the torque converter 30*a* developed as Archimedes screw. It is provided that in this way there is obtained a step-up ratio of 70. If one assumes that the throttle valve 9 is to be adjusted between the operating positions $LL_{min}$ and $LL_{max}$ within an angular region of 8° by the electric motor 14, this means that the drive shaft 80*b* is to be swung by 560°. In particular, the auxiliary spring 31 makes certain in this connection that, in the event of a defect in the electronic control device 17 or the electric motor 14, the friction/detent moment of the current-less electric motor 14 is overcome in every position so that the return of the throttle valve 9 into the idle emergency position is assured. Upon the stepping-up of the rotary movement of the drive shaft, the actual-value detection device 18 is advantageously arranged within the region of the swingable plate 83*b*, whereby a substantially improved power of resolution of the actual-value detection device 18 is obtained.

I claim:

1. A load adjustment device comprises a setting member, and a control element which acts on the setting member to determine an output of an internal combustion engine;

an electronic control device, and an electric setting drive which cooperates with the electronic control device;

a driver, an accelerator pedal connected to the driver, said control element cooperating with the driver and, in addition, being controllable by the electric setting drive;

an idle stop, an idle spring, and an emergency operation spring; and wherein an adjustment path of the driver in idling direction is limited by said idle stop;

upon a striking of the driver against said idle stop, the control element is moveable within an idling control range relative to the driver by means of the setting drive;

said control element includes a first control element part and a second control element part;

said first control element part cooperates with the driver;

said idle spring acts on said driver and urges said first control element part in a direction of minimum idle position over the entire idle control range;

said second control element part is controlled by means of said setting drive;

said emergency operation spring acts on said setting drive and urges said second control element part in the direction of the minimum idling position to an idling emergency position;

said first control element part extends on a side associated with the minimum idle position of the second control element part into a setting path thereof; and said second control element part comprises a torque converter developed as a spiral for coupling mechanical movement of said second control element part to said first control element part.

2. A device according to claim 1, further comprising a mounting shaft and a cam disk; and wherein said setting device includes a drive shaft;

the region of the second control element part, which extends into the setting path of the first control element part is developed as a lever which is swingable around said mounting shaft;

an end of the lever which is remote from the mounting shaft has a guide extension which is oriented parallel to the mounting shaft, said drive shaft of the setting drive is parallel to the mounting shaft; and said cam disk has spiral cutout in which the guide extension is guided, the cam disk being mounted rotatably on said drive shaft of said setting drive.

3. A device according to claim 2, further comprising a first stop; and wherein said guide extension passes through the cutout of said cam disk;

said first stop extends into a path of movement of said guide extension, and is mounted freely swingable on said drive shaft of the setting drive; and said emergency operation spring is developed as a spiral spring, one end of which is connected to said first stop and the other end to an anchor consisting of a stationary point or the cam disk.

4. A device according to claim 3, wherein the emergency operation spring is urged towards an emergency-position stop.

5. A device according to claim 4. wherein the emergency position stop is connected to the cam disk and extends into the path of movement of the first stop.

6. A device according to claim 2, wherein the spiral cutout is developed as a nonself-locking spiral.

7. A device according to claim 2, wherein the spiral cutout is developed as an Archimedes screw.

8. A device according to claim 1, wherein said torque converter provides step-up ratios from setting drive to setting member in a range of 50 to 200.

9. A device according to claim 1, wherein said torque converter provides step-up ratios from setting drive to setting member in a range of 70 to 100.

10. A device according to claim 2, further comprising an auxiliary spring which cooperates with the drive shaft of said setting drive to urge said setting drive in idling direction of said setting member over an entire idle control range.

11. A device according to claim 10, further comprising an extension of the setting drive shaft and a stationary point; and wherein said auxiliary spring is developed as a spiral spring which surrounds the setting drive shaft and which, at one end, acts on said extension arranged on said setting drive shaft and, on the other end, acts on said stationary point.

12. A device according to claim 2, further comprising a structural part which establishes a position of the second control element part to operate with said lever of said first control element part.

* * * * *